US006047562A

United States Patent [19]

Tranier

[11] Patent Number: 6,047,562

[45] Date of Patent: Apr. 11, 2000

[54] PROCESS AND PLANT FOR SEPARATING AIR BY CRYOGENIC DISTILLATION

[75] Inventor: Jean-Pierre Tranier, Paris, France

[73] Assignee: L'Air Liquide, Societe Anonyme Pour L'Etude et L'Exploitation des Procedes Georges Claude, Paris Cedex, France

[21] Appl. No.: 09/090,886

[22] Filed: Jun. 5, 1998

[30] Foreign Application Priority Data

Jun. 13, 1997 [FR] France ..... 97 07357

[51] Int. Cl.[7] ..... F25J 3/00

[52] U.S. Cl. ..... 62/646; 62/654

[58] Field of Search ..... 62/646, 654

[56] References Cited

U.S. PATENT DOCUMENTS

| | | | |
|---|---|---|---|
| 4,662,916 | 5/1987 | Agrawal et al. | 62/646 |
| 5,074,898 | 12/1991 | Chueng | 62/646 |
| 5,440,885 | 8/1995 | Arriulou | 62/646 |

FOREIGN PATENT DOCUMENTS

| | | |
|---|---|---|
| 0 153 673 | 9/1985 | European Pat. Off. . |
| 0 556 516 | 8/1993 | European Pat. Off. . |
| 1 289 009 | 2/1962 | France . |
| 36 43 359 | 6/1988 | Germany . |
| 1 271 419 | 4/1972 | United Kingdom . |

*Primary Examiner*—Ronald Capossela
*Attorney, Agent, or Firm*—Young & Thompson

[57] ABSTRACT

The air coming from a blowing turbine (13) and intended for the low-pressure column of a double column (2) is cooled by indirect heat exchange with a liquid (15, 20). This liquid is a purge stream from a condenser (5, 6) of the system.

9 Claims, 2 Drawing Sheets

PROCESS AND PLANT FOR SEPARATING AIR BY CRYOGENIC DISTILLATION

FIELD OF THE INVENTION

The present invention relates to a cryogenic distillation process and plant.

In particular, it relates to a process for separating air by cryogenic distillation in a double column comprising a medium-pressure column and a low-pressure column, in which a) a first stream of air is sent into the medium-pressure column where it separates into an oxygen-enriched liquid and a nitrogen-enriched vapour b) a second stream of air is expanded in a blowing turbine, cooled and sent into the low-pressure column c) nitrogen-enriched and oxygen-enriched fluids are produced in the low-pressure column.

BACKGROUND OF THE INVENTION

Processes of this type are known from DE-A-3, 843, 359 and DE-A-3, 643, 359 in which the air of the blowing turbine is cooled by heat exchange with an oxygen-enriched gas stream.

SU-A-739, 316 and SU-A-1, 231, 343 disclose cooling the air coming from a blowing turbine with a stream of nitrogen withdrawn from the medium-pressure column.

In "Proceedings of the British Cryogenics Council Conference, Nov. 13–15 1973" it is proposed to cool the blown air with a stream of residual gas coming from the low-pressure column.

EP-A-0, 081 473 suggests cooling the air expanded in the blowing turbine by heat exchange with a stream of air intended for the medium-pressure column.

EP-A-153, 673 describes an apparatus in which the stream of blown air is cooled by exchanging heat with the nitrogen from the top of the low-pressure column.

FR-A-1, 289, 009 describes cooling the blown air against a stream of pumped liquid oxygen.

EP-A-0, 556, 516 describes cooling the blown air against a rich liquid.

It is frequently necessary to warm a liquid stream coming from the column, for example so as to vaporize it (see EP-A-640, 802).

Thus, it has been proposed to vaporize a purge stream from the collector condenser in the main exchanger of the apparatus, but this requires manufacturing a main exchanger with an additional passage.

EP-A-605, 262 proposes vaporizing the liquid oxygen purges under pressure in order to avoid the risk of a hydrocarbon explosion.

SUMMARY OF THE INVENTION

The object of the present invention is to utilize the coldness of a liquid from the double column in an effective manner.

According to the present invention, a process for separating air by cryogenic distillation in a double column is provided. The process comprises a medium-pressure column and a low-pressure column, in which a) a first stream of air is sent into the medium-pressure column where it separates into an oxygen-enriched liquid and a nitrogen-enriched vapor, b) a second stream of air is expanded in a blowing turbine, cooled and sent into the low-pressure column, c) nitrogen-enriched and oxygen-enriched fluids are produced in the low-pressure column, the second stream being cooled after the expansion step by heat exchange with a liquid stream, characterized in that the liquid stream is a purge stream.

According to other aspects of the invention:

the liquid stream is at least partially vaporized by heat exchange with the blown air;

the liquid stream comes from the double column;

the liquid stream is a purge stream coming from the double column or from another column of the plant;

the medium-pressure column and the low-pressure column are thermally coupled by a collector condenser of the low-pressure column and the purge stream is a purge stream from this condenser;

the low-pressure column has a top condenser cooled by an oxygen-enriched stream and the liquid stream is a purge stream coming from the top condenser; and the liquid stream is pressurized before exchanging heat with the blown air.

According to the present invention, a plant for separating air by cryogenic distillation in a double column is also provided. The plant comprises a medium-pressure column and a low-pressure column, means for sending a first stream of cooled air into the medium-pressure column, means for sending a second stream of cooled air into a blowing turbine, means for sending the expanded second stream to a heat exchanger, means for sending the expanded second stream from the heat exchanger to the low-pressure column, means for sending a liquid from the collector of the medium-pressure column to the low-pressure column, and means for sending a liquid to the exchanger, characterized in that the liquid sent to the exchanger is a purge liquid from a condenser of the plant.

According to other aspects of the invention the condenser is a collector condenser or a top condenser of the low-pressure column.

Two ways of implementing the invention will now be described with regard to the appended drawing, in which;

FIGS. 1 and 2 are diagrams of plants according to the invention.

DETAILED DESCRIPTION OF THE INVENTION

Figure 1:
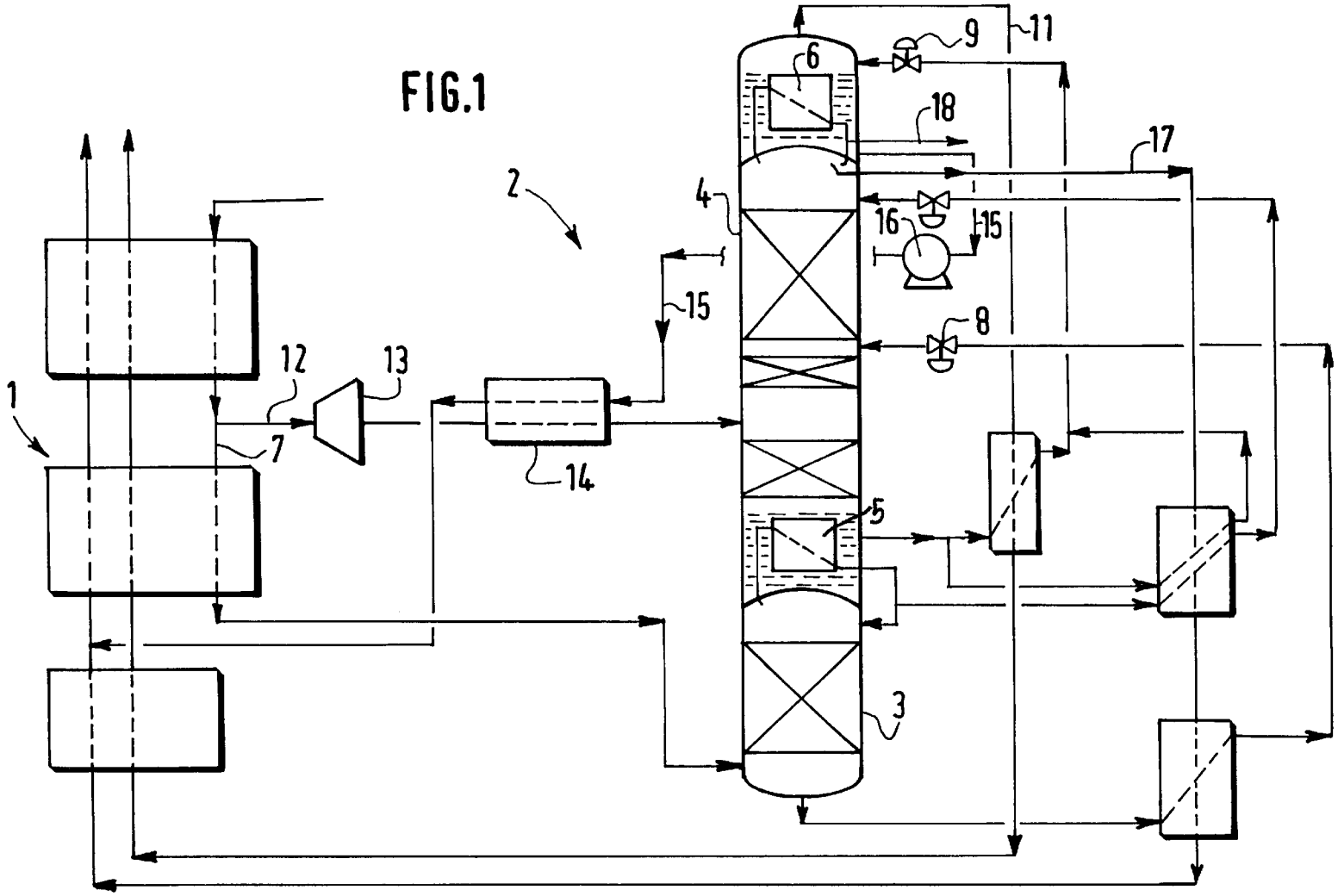

FIG. 1 shows a nitrogen production plant similar to those described in FR-A-2, 578, 532, EP-A-153, 673 and EP-A-575, 591. It comprises a heat-exchange line 1 and a double distillation column 2. The latter consists of a medium-pressure column 3 operating at a pressure of about 8 to 10 bar and of a low-pressure column operating at a pressure of about 4 to 5 bar. Each of these columns includes a top condenser 5, 6, respectively.

A first stream of air 7 compressed to a pressure slightly above the medium pressure is cooled near its dew point through the exchange line 1 and introduced into the bottom of the column 3. The rich liquid in equilibrium with this air, collected in the collector of the column 3, is expanded at low pressure in an expansion valve 8 and introduced at an intermediate point on the column 4. In the latter, the descending liquid is enriched with oxygen and, at the collector, cools the main condenser 5 in order to ensure reflux in the column 3. Part of the same liquid is expanded again, to a pressure of about 1 bar, in an expansion valve 9 and then serves to cool the auxiliary condenser 6 in order to ensure reflux in column 4. The same liquid after vaporization is sent as a countercurrent via a pipe 11 through the exchange line 1 in order to constitute the residual gas of the plant.

The vapour which rises in the column 4 is enriched with nitrogen and it is the nitrogen which is condensed by the auxiliary condenser 6.

A second stream of air 12 is expanded in a blowing turbine 13, is cooled in the exchanger 14 and is introduced into the low-pressure column 4. A liquid purge stream 15 containing approximately 82% oxygen is withdrawn from the auxiliary condenser, is pressurized by the pump 16 and sent into the exchanger 14 where it vaporizes. The vaporized purge stream is then discharged from the plant.

Gaseous nitrogen 17 is withdrawn from the top of the column 4 as product. There is also a small production of liquid nitrogen 18.

Figure 2:
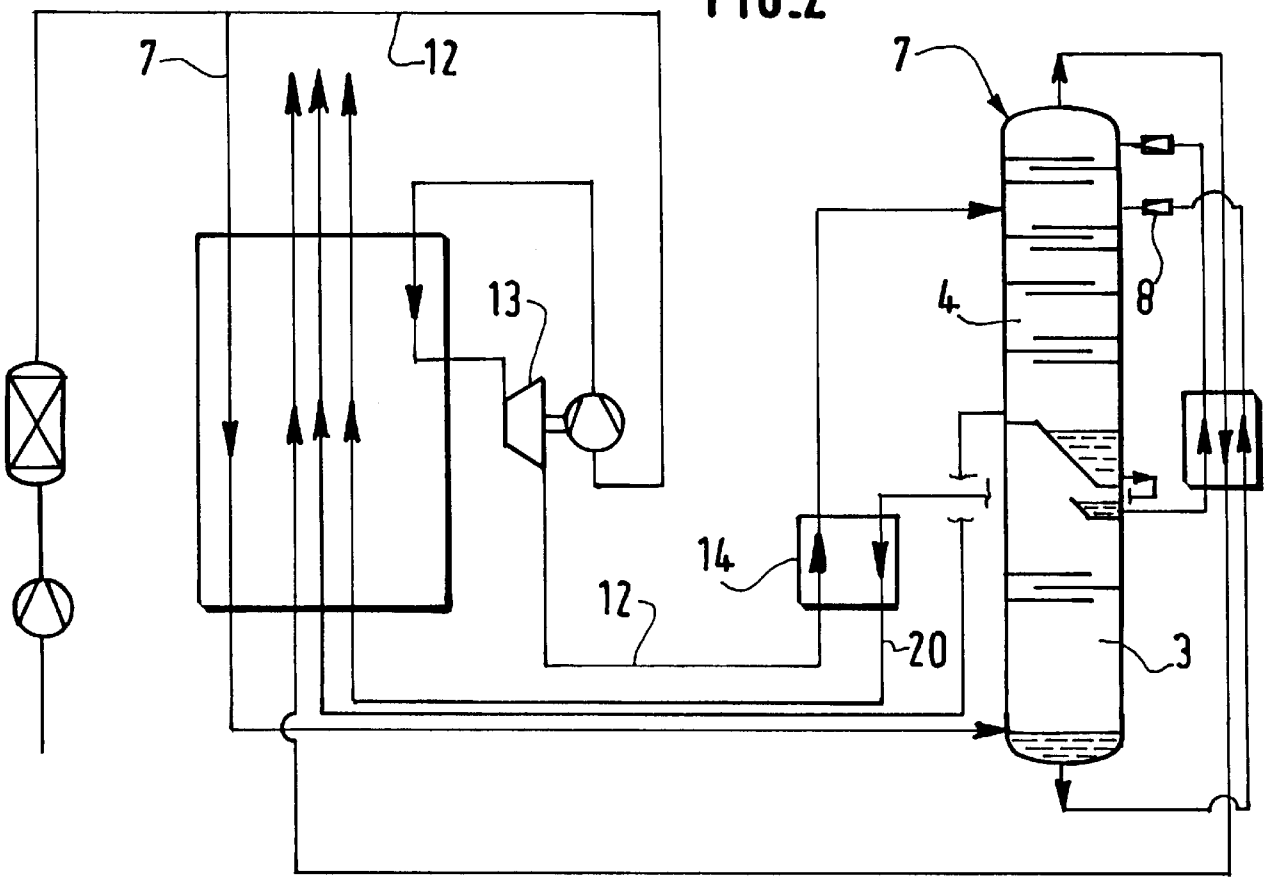

In the variant shown in FIG. 2, the low-pressure column 4 does not have a top condenser. The oxygen in the collector of the column 4 is withdrawn as product and a liquid purge stream 20 from this collector vaporizes by heat exchange with the blown air, after an optional pressurization step.

The purge liquid, which serves to cool the air coming from the blowing turbine, could also be a purge coming from another column of the plant (Etienne column or argon column).

I claim:

1. Process for separating air by cryogenic distillation in a double column comprising a medium-pressure column and a low-pressure column, which comprises:

a) sending a first stream of air into the medium-pressure column where it separates into an oxygen-enriched liquid and a nitrogen-enriched vapor;

b) expanding a second stream of air in a blowing turbine so as to obtain an expanded second stream of air;

c) cooling the expanded second stream of air by heat exchange with a liquid stream so as to obtain a cooled second stream of air;

d) sending the cooled second stream of air into the low-pressure column; and e) producing nitrogen-enriched and oxygen-enriched fluids in the low-pressure column;

wherein the liquid stream is a purge stream.

2. Process according to claim 1, wherein the purge stream is at least partially vaporized by heat exchange with the expanded second stream of air.

3. Process according to claim 1, wherein the purge stream originates from the double column.

4. Process according to claim 3, wherein the purge stream originates from one of an argon column and an Etienne column associated with the double column.

5. Process according to claim 4, wherein the medium-pressure column and the low-pressure column are thermally coupled by a collector condenser of the low-pressure column and the purge stream is a purge stream from said condenser.

6. Process according to claim 4, wherein the low-pressure column has a top condenser cooled by an oxygen-enriched stream and the liquid stream is a purge stream originating from the top condenser.

7. Process according to claim 1, wherein the liquid stream is pressurized before exchanging heat with the expanded second stream of air.

8. Plant for separating air by cryogenic distillation comprising:

a double column comprised of a medium-pressure column and a low-pressure column;

means for sending a first stream of cooled air into the medium-pressure column;

means for sending a second stream of air into a blowing turbine so as to obtain an expanded second stream of air;

means for sending the expanded second stream of air to a heat exchanger so as to obtain a cooled second stream of air;

means for sending the cooled second stream of air from the heat exchanger to the low-pressure column;

means for sending a liquid from a collector of the medium-pressure column to the low-pressure column; and means for sending a liquid to the heat exchanger;

wherein the liquid sent to the heat exchanger is a purge liquid from a condenser of the plant.

9. Plant according to claim 8, wherein the condenser is one of a collector condenser, a top condenser of the low-pressure column, an argon column condenser, and an Etienne-column condenser.

* * * * *